US012644685B2

(12) United States Patent
Worrall et al.

(10) Patent No.: US 12,644,685 B2
(45) Date of Patent: Jun. 2, 2026

(54) COMMON CARRIER MUNITION

(71) Applicant: BAE SYSTEMS PLC, London (GB)

(72) Inventors: Benjamin Daniel Worrall, USK Monmouth (GB); Thomas William Tyrell, USK Monmouth (GB); Andrew David Williams, USK Monmouth (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 18/996,561

(22) PCT Filed: Jul. 7, 2023

(86) PCT No.: PCT/GB2023/051794

§ 371 (c)(1),
(2) Date: Jan. 17, 2025

(87) PCT Pub. No.: WO2024/018178

PCT Pub. Date: Jan. 25, 2024

(65) Prior Publication Data

US 2026/0022923 A1 Jan. 22, 2026

(30) Foreign Application Priority Data

Jul. 18, 2022 (GB) ..... 2210499

(51) Int. Cl.
*F42B 12/20* (2006.01)
*F42B 12/62* (2006.01)

(52) U.S. Cl.
CPC ..... *F42B 12/207* (2013.01); *F42B 12/62* (2013.01); *F42B 12/625* (2013.01)

(58) Field of Classification Search
CPC ..... F42B 12/207; F42B 30/08; F42B 30/10; F42B 30/12; F42B 12/62; F42B 12/625
See application file for complete search history.

(56) References Cited

U.S. PATENT DOCUMENTS 382,223 A * 5/1888 Graydon ..... F42B 12/208 102/478
2,358,403 A * 9/1944 Le Gore ..... F42B 23/14 102/428

(Continued)

FOREIGN PATENT DOCUMENTS

DE 102019004456 B3 11/2020
GB 1396279 A 6/1975

(Continued)

OTHER PUBLICATIONS

GB Search Report under Section 17(5) received for GB Application No. 2210499.6, dated Jan. 10, 2023. 3 pages.

(Continued)

*Primary Examiner* — Joshua E Freeman
(74) *Attorney, Agent, or Firm* — Arcane Law PLLC

(57) ABSTRACT

The invention relates to a common carrier munition ammunition device, more particularly to common carrier payload delivery shell.

There is provided a common carrier munition suitable for use for a high explosive comprising a tail unit, a main body which comprises a payload cavity for receiving a payload, a fuze, and located between said main body and the fuze an ogive element, wherein the payload comprises a removable liner, wherein the removable liner comprises a high explosive, such that said removable liner and high explosive may be removed from the payload cavity.

19 Claims, 2 Drawing Sheets

(56) References Cited

U.S. PATENT DOCUMENTS

| | | | | |
|---|---|---|---|---|
| 3,677,182 | A * | 7/1972 | Peterson | F42B 12/62 102/505 |
| 4,438,700 | A * | 3/1984 | Knapp | C06B 33/12 149/40 |
| 4,860,659 | A * | 8/1989 | Andreetta | F42B 30/08 102/491 |
| 5,210,372 | A * | 5/1993 | Tripptrap | F42B 12/62 102/357 |
| 5,317,975 | A * | 6/1994 | Sauvestre | F42B 12/62 102/357 |
| 7,331,292 | B1 * | 2/2008 | Kim | F42B 15/34 102/473 |
| 2004/0031380 | A1 * | 2/2004 | Altenau | F42B 12/208 86/51 |
| 2004/0107860 | A1 * | 6/2004 | Loubser | F42B 12/62 102/481 |
| 2004/0134372 | A1 * | 7/2004 | Scherer | F42B 12/48 102/499 |
| 2006/0011053 | A1 | 1/2006 | Altenau | |
| 2012/0137918 | A1 * | 6/2012 | Dau | F42B 12/207 102/473 |
| 2016/0202031 | A1 * | 7/2016 | Rumfitt | F42B 12/64 102/334 |
| 2016/0209189 | A1 * | 7/2016 | Adams | F42B 12/42 |
| 2016/0209190 | A1 * | 7/2016 | Jones | F42B 12/625 |
| 2019/0128654 | A1 * | 5/2019 | Siggers | F42B 33/0207 |
| 2020/0191538 | A1 * | 6/2020 | Benade | F42B 39/20 |
| 2023/0003494 | A1 * | 1/2023 | Hagberg | F42B 10/50 |

FOREIGN PATENT DOCUMENTS

| | | | |
|---|---|---|---|
| WO | WO2015025143 | A1 | 2/2015 |
| WO | WO2024018178 | A1 | 1/2024 |

OTHER PUBLICATIONS

International Search Report and Written Opinion Received for PCT/GB 2023/051794, dated Nov. 15, 2023. 17 pages.

* cited by examiner

COMMON CARRIER MUNITION

The invention relates to a common carrier munition device, more particularly to common carrier high explosive shell.

There are many types of munitions that are deployed from ordnance during engagement, with a variety of payloads including high explosives, illumination, smokes, decoys, UAVs etc.

According to a first aspect of the invention there is provided a common carrier munition suitable for use for a high explosive, comprising a tail unit, a main body which comprises a payload cavity for receiving a payload, a fuze, and located between said main body and the fuze an ogive element, wherein the payload comprises a removable liner, wherein the removable liner comprises a high explosive, such that said removable liner and high explosive may be reversibly loaded in the payload cavity.

The liner may be made from any suitable explosively compatible material, such as for example a polymer or metal. The polymer may be selected from any suitable type, such as for example polyethylene, polypropylene, polystyrene, polyvinyl chloride, synthetic rubber, phenol formaldehyde resin, neoprene, nylon, polyacrylonitrile, perfluoropolymers and silicone. The metal may be aluminium, steel, or metal alloys.

Typically high explosive shells, the high explosive fill is cast directly into the empty shell, to maximise the amount of high explosive in the munition.

The use of non-removable liners is known, which are liner materials that are located in the empty shell, and are subsequently filled with high explosive into the empty shell. These liners cannot be removed once the high explosive has been cured or cast. The only means of removing current high explosive, is to cut open the shell, use chemicals, burn or otherwise use hazardous process steps.

The payload cavity and the removable liner have a co-operative fit. This allows the removable liner and high explosive fill to be both inserted and removed from the shell.

The removable liner and high explosive fill may be assessed for quality before being inserted into the payload cavity. It is more facile to assess the high explosive fill for cracks or defects, such as, for example by the use of X-ray or other NDT techniques, without having to perform these techniques through the metal shell, once filled. Therefore only removable liners with their high explosive fills that pass QC controls progress for final assembly.

Demil of unwanted or expired rounds, may be facilitated as the removable liner can be readily extracted from a completed shell, therefore avoiding costly and hazardous cutting, burning or worse detonation of shells, as hereinbefore described.

Further, at forward operating positions, common carrier shells allow for the selection of different payloads, the high explosive fill in the removable liner, may be swapped out and replaced by an illumination, smoke or electronic payload or vice versa.

During gun launch large setback and spin forces are exerted on the shell and its contents, preferably the payload cavity and the removable liner have a co-operative fit, more preferably the removable liner has an ogive profile, more preferably the payload cavity and the removable liner both have co-operative ogive profiles. The removable liner may be locked in position with a reversible retaining means, such as a locking ring, pins, resilient means etc.

The ogive element and main body may be unitary body or separate elements which when secured together provide a unitary body. The separate elements may comprise cooperatively engaging male and female threaded portions, wherein at least one of the threads may be a shearable thread, to provide a frangible link.

The fuze may be operably connected to an explosive train, capable in use of initiating the high explosive.

The payload cavity may comprise one or more modular high explosive charges, wherein each modular high explosive charge is in a removable liner. The singular or plurality of modular high explosive charges, may be reversibly loadable from the aft end of the main body. The use of modular charges, may provide a tuneable output effect, by the selection of the amount of high explosive in the shell.

According to a further aspect of the invention there is provided a kit of parts common carrier shell comprising a shell body comprising a uniform payload cavity for receiving a uniform payload, a removable liner comprising the high explosive, a fuze which when assembled provides a final high explosive shell.

According to a further aspect of the invention there is provided a method of transporting a common carrier shell, comprising transporting the fuze and removable liner comprising the high explosive in a first mode of transport suitable for carrying explosives, and transporting the shell body, ogive portion and tail unit in a second mode of transport. The first mode of transport may require specialist vehicles or military vehicles to safely transport energetic materials. The second mode of transport, will only need to transport empty shell bodies, ogive portions, and other non-explosive components. Thereby reducing the burden on specialist transports. The specialist transport may then be able to carry more energetic materials, as there are no shell casings and other heavy metal components.

In a further arrangement the tail unit may comprise a thread, shear pins or a shearable thread, the use of threaded connectors allows the payload to be reversibly loaded and or removed from the aft of the main body.

Prior art shells are fitted with shearable pins, which irreversibly secure the tail unit to the main body, such that once the munition is constructed the tail unit may only be removed by action of the device or by applying substantial force, to cause shearing of the pins. The use of a shearable thread allows the tail unit to be readily fitted and removed without damaging the shearable linkage. It is therefore possible to remove the payload for routine disposal.

The main body may be a unitary main body, or may be split into discrete rear section and front ogive section. They may be reversibly joined together by co-operative threads. The threads may further comprise a frangible link in the form of a shearable thread.

The main body threaded portion may be manufactured from a first material, and the ogive unit or the tail unit threaded portion may be manufactured from second material, wherein the second material has a lower hardness value than the first material, such that upon an applied force, such as, for example the pressure of an impact where the munition failed to function or only partly functioned, the pressure causing the lower hardness material to readily undergoes plastic deformation such that the tail unit and or ogive unit disengages from the main body.

In a highly preferred arrangement the first material is selected from a steel alloy and the second material is selected from aluminium or alloy thereof.

The payload may be inserted into the payload cavity from the aft end of the munition. The payload may be slidably engaged with the payload cavity, such as for example it may have an engineering fit with payload cavity, such that the payload may be prevented from moving within a direction which is normal to the elongate axis of the munition. On gun launch the set back force will ensure transfer of any imparted spin from the shell to the removable liner.

The high explosive payload may be removed and replaced with other commonly used payload such as, for example, illumination, smokes, decoys, chaff or a UAV. The payload and payload cavity are selected such that they are preferably of a uniform dimension, such that any payload may be readily inserted into the uniform payload cavity of the munition.

The fuze may be operably connected to an explosive train, to provide an energetic output, such as a detonative output. The fuze device may comprise safety and arming units (SAU) and an explosive train to provide sufficient stimuli to the high explosive fill.

The fuze may be any known fuze, such as those that respond to selected input or stimuli or a combination of inputs, such as, for example, mechanical actions of the projectile, such as the action of high g forces from gun launch or high spin rates from imparted spin, timed delay, either mechanical or pyrotechnic, caused by separation from the launch system, or proximity to a target. The fuze may be an electronic fuze, one which functions due to electronic activation, such as, for example, from an input from a sensor or detector from on-board said munition or external to the munition. On-board systems may be internal guidance systems. External stimuli may be provided such as, for example, by fly-by wire, remote control, GPS or target activated laser guidance.

Whilst the invention has been described above, it extends to any inventive combination of the features set out above, or in the following description, drawings or claims.

Exemplary embodiments of the device in accordance with the invention will now be described with reference to the accompanying drawings in which.

Figure 1:
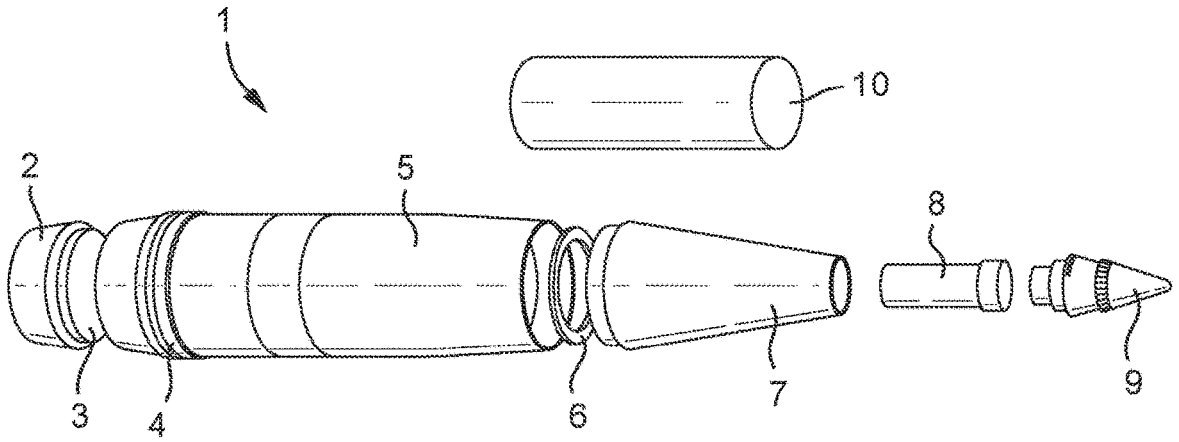
FIG. 1 show an exploded side view of a prior art illumination shell.

Turning to FIG. 1 there is provided a prior art illumination shell 1, with a main body 5, which is manufactured from a steel alloy. Located around the circumference of the main body 5 is a copper driving band 4, which allows engagement with the rifling on the bore of a barrel, so as to impart spin. A tail unit 2 is located at the aft of the main body 5. The tail unit 2 is made from aluminium and contains a male threaded portion 3, which engages with a reciprocal female threaded portion (not shown) located in the aft of the main body 5. The payload 10 (shown external to the shell 1), when located in the payload cavity (not shown), inside the main body, is retained in place by use of a locking ring 6, which screws into the forward end of main body 5. The ogive element 7 is removable and is fastened to the locking ring 6. The ogive element receives the expulsion charge 8 and fuze 9. Upon operation of the fuze 9, the expulsion charge 8 builds up pressure within the ogive element and at the bursting pressure the thread 3 shears and the payload 10 is expelled from the aft of the main body 5. The payload 10 is of uniform dimension may be deliver a smoke, illumination, UAV etc. output.

Figure 2:
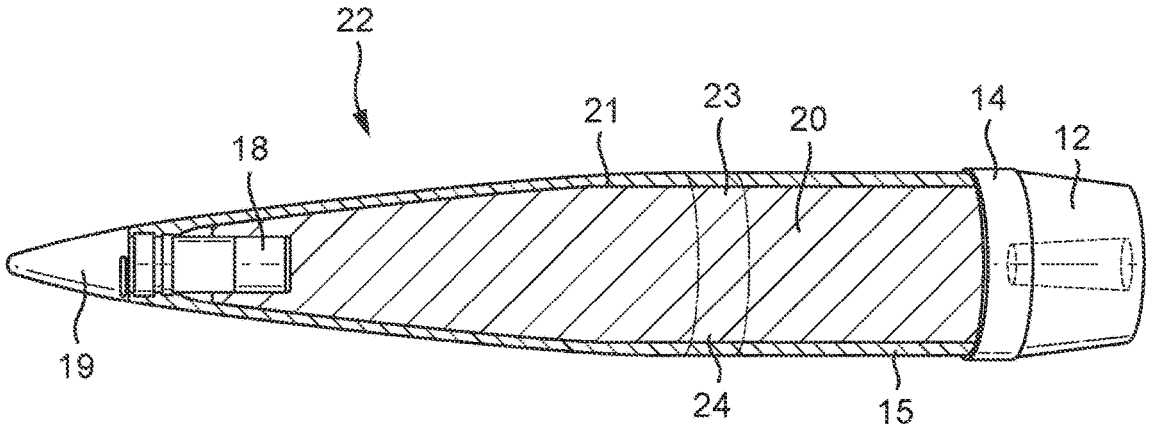
FIG. 2 shows a cross section of a high explosive shell, of the invention

FIG. 2 shows a high explosive shell 22, with a unitary main body 15 formed from a steel alloy, with a driving band 14 located thereupon. A tail unit 12 is located at the aft of the main body 15. The tail unit 12 is made from aluminium and contains a male threaded portion, which engages with a reciprocal female threaded portion located at the aft of the main body 15. The tail unit 12 may be a boat tail or base bleed unit.

The payload 23 is located in the payload cavity 24. The payload is a removable liner 21 which is pre-filled with a high explosive 20. The removable liner 21 and high explosive 20 are loaded into the payload cavity 24 in a single step.

The ogive element receives the explosive train 18 and fuze 19. Upon operation of the fuze 19, the explosive train 18 provides a greater detonative event sufficient to detonate the high explosive 20.

Figure 3:
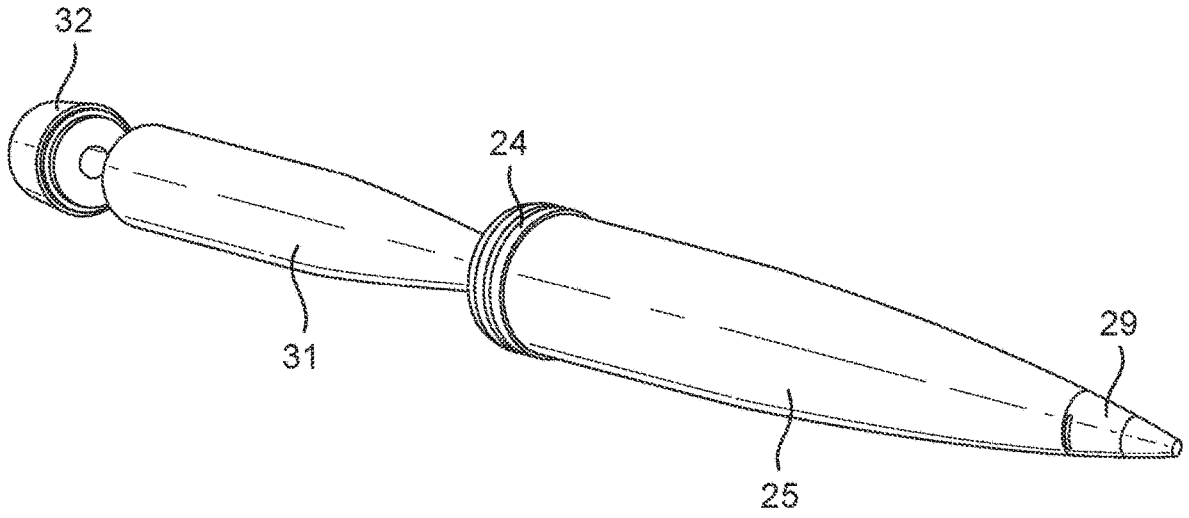
FIG. 3 shows an exploded view of the removable high explosive liner and shell.

FIG. 3 shows an empty shell 25, with a fuze 29, located at the forward end. The removable liner 31 which contains the high explosive fill (not shown) may be inserted from the rear of the shell 25. The tail unit 32 may then be secured to the shell 25 to provide the complete shell. The tail unit 32 may be secured to the main body 25 by a cooperative thread, shearable cooperative thread, or shear pins.

The invention claimed is:

1. A common carrier munition suitable for use for a high explosive, the munition comprising:

a tail unit;

a main body including a payload cavity for receiving a payload;

a removable liner having a co-operative fit with the payload cavity to allow the removable liner to receive a fill of high explosive, such that the removable liner and the fill of high explosive can be inserted and removed from the payload cavity;

a fuze; and an ogive element located between the main body and the fuze, wherein the tail unit includes a cooperative thread, shearable cooperative thread, or shear pins to allow the payload to be inserted and removed from an aft of the main body.

2. The munition according to claim 1, wherein the removable liner is made from a polymer or metal.

3. The munition according to claim 1, wherein the removable liner has an ogive profile.

4. The munition according to claim 3, wherein the payload cavity and the removable liner both have a co-operative ogive profile.

5. The munition according to claim 1, wherein the ogive element and the main body are a unitary body.

6. The munition according to claim 1, wherein the ogive element and main body are separate elements, and the separate elements comprise cooperatively engaging male and female threaded portions, wherein at least one of the threads is a shearable thread, to provide a frangible link.

7. The munition according to claim 6, wherein the main body comprises a threaded portion manufactured from a first material, and the ogive element comprises a threaded portion manufactured from second material, wherein the second material has a lower hardness value than the first material.

8. The munition according to claim 7, wherein the first material is selected from a steel alloy and the second material is selected from aluminium or alloy thereof.

9. The munition according to claim 6, wherein the ogive element is reversibly engaged with the fuze and main body.

10. The munition according to claim 1, wherein the fuze is operably connected to an explosive train, capable in use of initiating the high explosive.

11. The munition according to claim 1, wherein the payload cavity comprises one or more modular high explosive charges, wherein each modular higher explosive charge is in a removable liner.

12. The munition according to claim 11, wherein each of the one or more modular high explosive charges is reversibly loadable from the aft end of the main body.

13. A method of transporting a common carrier shell, the common carrier shell including a fuze, a removable liner including a high explosive fill, a shell body including a payload cavity, an ogive element, and a tail unit, the removable liner having a co-operative fit with the payload cavity to allow the removable liner—to receive the high explosive fill such that the removable liner and the high explosive fill can be inserted and removed from the payload cavity, the method comprising:

transporting the fuze and removable liner including the high explosive fill in a first mode of transport suitable for carrying explosives; and transporting the shell body, ogive element, and tail unit in a second mode of transport.

14. A common carrier munition suitable for use for a high explosive, the munition comprising:

a main body formed from a steel alloy and which comprises a payload cavity for receiving a payload;

a tail unit located at an aft of the main body and made from aluminium, the tail unit secured to the main body by a cooperative thread, shearable cooperative thread, or shear pins;

a removable liner, having a co-operative fit with the payload cavity to allow the removable liner to receive a fill of high explosive, such that the removable liner and the fill of high explosive can be inserted and removed from the payload cavity;

a fuze; and an ogive element located between the main body and the fuze;

wherein the payload cavity and the removable liner both have a co-operative ogive profile.

15. The munition according to claim 14, wherein the tail unit is a boat tail unit, and the ogive element and the main body are a unitary body.

16. The munition according to claim 15, wherein the fuze is operably connected to an explosive train, capable in use of initiating the high explosive.

17. The munition according to claim 14, wherein the ogive element and main body are separate elements, and the separate elements comprise cooperatively engaging male and female threaded portions, wherein at least one of the threads is a shearable thread, to provide a frangible link.

18. The munition according to claim 14, wherein the ogive element is reversibly engaged with the fuze and main body.

19. The munition according to claim 14, wherein the removable liner is lockable in position with a reversible retaining mechanism.

* * * * *